US005924391A

United States Patent [19]

Baker, IV et al.

[11] Patent Number: 5,924,391

[45] Date of Patent: Jul. 20, 1999

[54] WATER HEATING APPARATUS

[75] Inventors: James B. Baker, IV; Jack Nichols, both of Fort Worth, Tex.

[73] Assignee: Direct Fire Technical, Inc., Fort Worth, Tex.

[21] Appl. No.: 08/932,326

[22] Filed: Sep. 17, 1997

[51] Int. Cl.[6] ..... F22B 23/06

[52] U.S. Cl. ..... 122/367.1; 126/360 R; 126/360 A; 126/355

[58] Field of Search ..... 122/32, 33, 34, 122/367.1, 367.2, 367.3; 126/355, 360 R, 360 A

[56] References Cited

U.S. PATENT DOCUMENTS

| | | | |
|---|---|---|---|
| 4,596,235 | 6/1986 | Bougard | 126/355 |
| 4,685,444 | 8/1987 | Durrenberger | 126/360 A |
| 4,846,148 | 7/1989 | Zifferer | 126/355 |

*Primary Examiner*—Teresa Walberg
*Assistant Examiner*—Jiping Lu
*Attorney, Agent, or Firm*—Arthur F Zobal

[57] ABSTRACT

The water heating apparatus is formed by a container having spaced upper and lower walls and a cylindrical side wall having upper and lower portions extending between the upper and lower walls defining an interior of the container. An inlet opening is formed through the central portion of the upper wall. An elongated hollow flame tube is located within the interior of the container and has an upper end coupled to the inlet opening of the upper wall and extends downward. A combustion device is coupled to the inlet opening of the upper wall for directing a flame into the flame tube by way of the upper opening. A plurality of water nozzles coupled together at spaced apart positions by conduits are located in the upper portion of the interior of said container below the upper wall and at spaced apart positions around the upper portion of the flame tube for directing water against the flame tube for cooling purposes and downward into the zone between the flame tube and the side wall for forming hot water for flow into the lower portion of the interior of the container. An exhaust opening for an exhaust device is formed through the upper wall. The upper wall is removably coupled to the upper end of the side wall. The upper and lower portions of the side wall are removably coupled together.

7 Claims, 6 Drawing Sheets

WATER HEATING APPARATUS

BACKGROUND OF THE INVENTION

1. Field of the Invention

The invention relates to a direct fire or direct contact water heater.

2. Description of the Prior Art

U.S. Pat. Nos. 4,275,708; 4,753,220; 4,765,280; 4,773,390; 5,168,861; 5,305,735; 5,368,474; 5,479,913 disclose direct contact water heaters.

SUMMARY OF THE INVENTION

It is an object of the invention to provide a direct fire or direct contact water heater which has advantages over the prior art direct fire or direct contact water heaters.

The apparatus of the invention comprises a container having spaced upper and lower walls and a side wall extending between the upper and lower walls defining an interior of the container. An inlet opening is formed through the upper wall. An elongated hollow flame tube is located within the interior of the container and has an upper end coupled to the inlet opening of the upper wall and extends downward. Combustion means is coupled to the upper wall for directing flame into the flame tube by way of the upper opening. A plurality of water nozzles coupled together at spaced apart positions by conduits are located in the upper portion of the interior of the container below the upper wall and at spaced apart positions around the upper portion of the flame tube for directing water against the upper portion of the flame tube for cooling the flame tube and downward into the zone between the flame tube and the side wall for forming hot water for flow into the lower portion of the interior of the container.

In another aspect, the inlet opening is located in the central portion of the upper wall. An exhaust opening is formed through the upper wall between the inlet opening and the outer edge of the upper wall. The combustion means and exhaust means are coupled to the inlet and exhaust openings. The upper wall is removably coupled to the side wall such that the upper wall and hence the combustion means and the exhaust means may be located at different angular positions relative to the upper end of the side wall.

In a further aspect, the side wall is a cylindrical wall having an upper portion and a lower portion. The upper and lower portions have lower and upper ends respectively. The upper wall is removably coupled to the upper end of the upper portion and the lower wall is coupled to the lower end of the lower portion. The upper and lower portions have lower and upper ends respectively removably coupled together such that the upper and lower portions may be coupled together at different angular positions relative to each other.

DESCRIPTION OF THE PREFERRED EMBODIMENTS

Figure 1:
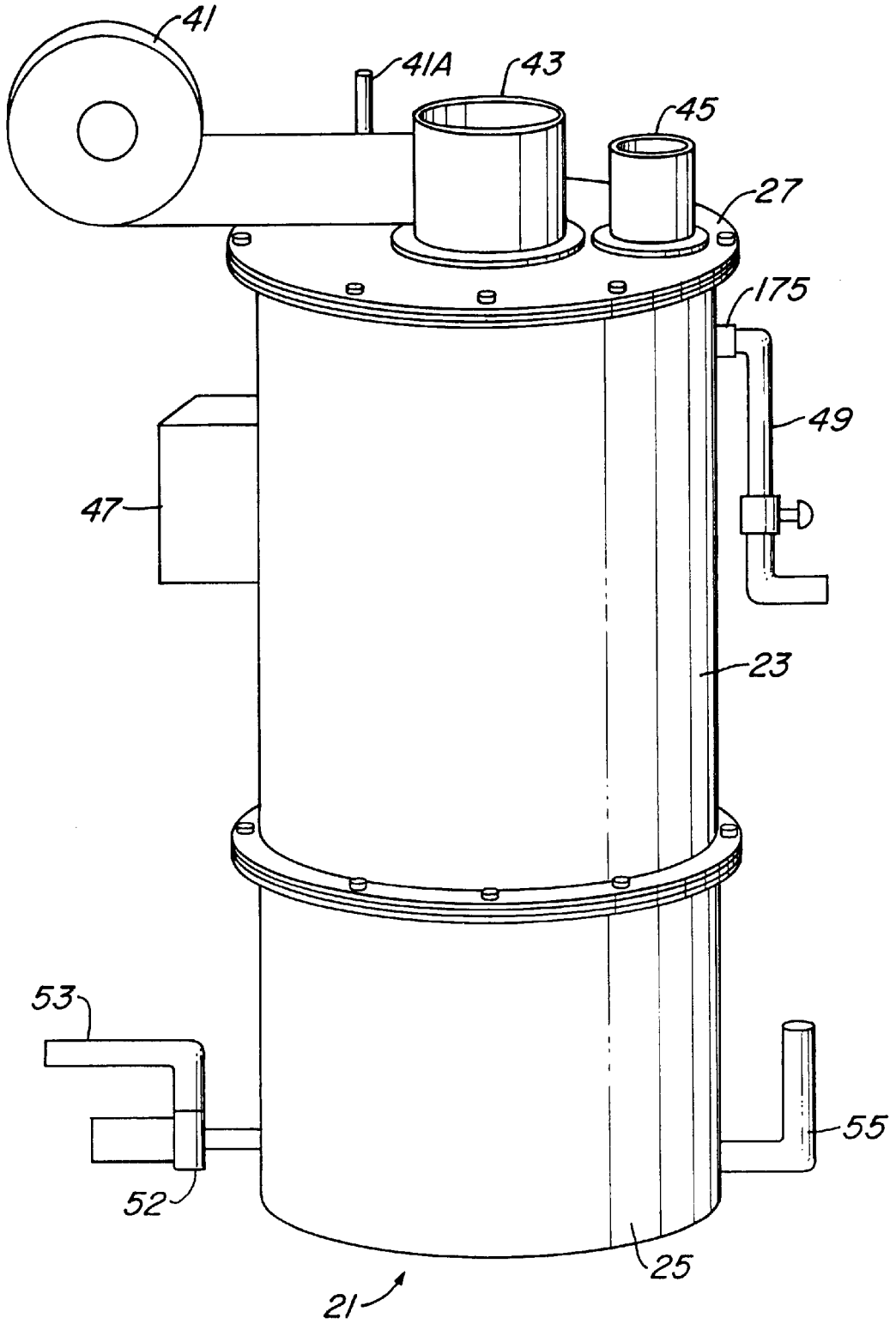
FIG. 1 is an exterior side view of the water heater of the invention.

Referring now to the drawings, the water heating apparatus of the invention is indicated by reference numeral 21. It includes upper and lower cylindrical side walls 23 and 25 removably coupled together, a circular upper wall 27 removably coupled to the upper end of side wall 23 and a circular lower wall 29 coupled to the lower end of wall 25.

Coupled to the upper wall 27 are an air blower 41, a burner 43, and an exhaust 45. The upper wall 27 has a central aperture 51 and an offset aperture 53 formed therethrough for receiving the burner 43 and exhaust 45.

Coupled to the exterior of the upper side wall 23 are a control box 47 and a cold water inlet 49.

Coupled to the exterior of the lower side wall 25 are a discharge pump 52 and a hot water outlet 53 and an overflow pipe 55 with level switching devices for pump control.

The lower end of wall 23 has a flange 23FL with apertures 23AL formed therethrough and an upper flange 23FU with apertures 23AU formed therethrough. The upper end of wall 25 has an upper flange 25F with apertures 25A formed therethrough. The upper wall 27 has apertures 27A formed therethrough. Annular seals 33 and 35 with apertures 33A and 35A formed therethrough also are provided.

The apertures 27A, 33A, and 23AU all are formed through their members along circles of the same radius R. The arcuate distance between all adjacent apertures 27A; between all adjacent apertures 33A; and between all adjacent apertures 23AU is equal to the same distance A. Bolts 61 and nuts 63 are provided for securing wall 27 to flange 23AU with the seal 33 located therebetween. The shaft of the bolts 61 will fit through a set of aligned apertures 27A, 33A, and 23AU for coupling purposes. The upper wall 27 may be located on the flange 23AU at a plurality of different angular positions around the axis of the wall 23 and at these different positions the apertures 27A will be aligned with the apertures 33A and 23AU. This allows the upper wall 27 with the air blower 41, burner 43 and exhaust 45 coupled to the flange 23FU at different angular positions relative to the cylindrical walls 23 and 25.

The arrangement for coupling together the two cylindrical walls 23 and 25 also allows them to be coupled together at different angular positions relative to each other. In this respect, the apertures 23AL, 35A, and 25A all are formed through their members along circles of the same radius R. The arcuate distance between all adjacent apertures 23AL; between all adjacent apertures 35A; and between all adjacent apertures 25A is equal to the same distance A. This allows the flange 23FL and hence the wall 23 to be coupled to flange 25F of cylinder 25 at different angular positions around the axis of the cylinders. At each of these positions apertures 23AL, 35A, and 25A will be aligned for receiving the shafts of bolts 65 such that the bolts 65 may be screwed to nuts 67.

The burner 43 has a flange 71 with apertures 73 formed therethrough which align with apertures 75 formed through the upper wall 27 such that the bolts 81 can extend through apertures 73 and 75 to couple the burner to the upper wall 27. The flange 71 and hence the burner 43 and blower 41 can be located at least four different positions relative to the axis of the upper wall 27. At each position, the apertures 73 are aligned with apertures 75 such that the burner 43 and blower 41 can be coupled to the upper wall 27 at different angular positions relative to its axis. The exhaust 45 has a flange 45F with apertures 45A formed therethrough and is coupled to the wall 27 by bolts 85 which extend through apertures 45A and 27B and are screwed to nuts (not shown).

The arrangement and feature for allowing the upper wall 27 to be removably coupled to the cylindrical wall 23 at different angular positions and for allowing the two cylindrical walls 23 and 25 to be removably coupled together at different angular positions relative to each other enhances the ability to locate the apparatus 21 in different areas of a building depending on the positions of the fuel line, exhaust pipe and water line. This removable coupling arrangement also facilitates disassembly and cleaning and routine maintenance and also transportation and shipping of the apparatus.

The apparatus includes a hollow cylindrical flame tube 91 having an opening 93 extending therethrough and having an upper flange 95 with apertures 97 formed therethrough. An annular ring 101 is attached to support members 103 which are attached to the upper inside edge of side wall 23. The ring 101 has threaded apertures 105 formed therethrough. The tube 91 is extended through the opening of the ring 101. The apertures 105, 97, 75, and 73 are aligned and are attached together with the bolts 81 screwed into threaded apertures 105 of ring 101.

Figure 8:
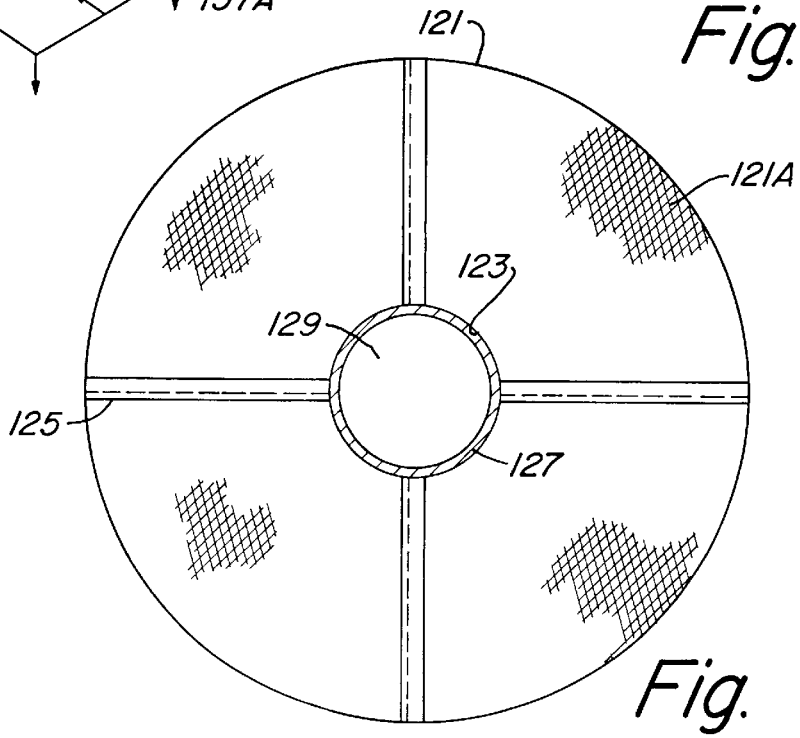
FIG. 8 is a cross-sectional view of FIG. 2 as seen from lines 8—8 thereof.

Also provided is a expanded metal wall 121 (which is shown partially in FIG. 8) having a central aperture 123. The wall 121 is supported by support members 125 which have a central ring 127 connected thereto. The members 125 have their outer edges connected to the inside lower edge of the wall 25.

The flame tube extends downward through aperture 129 of ring 127 to a level about flush the level of the flanges 23FL and 25F.

Figure 2:
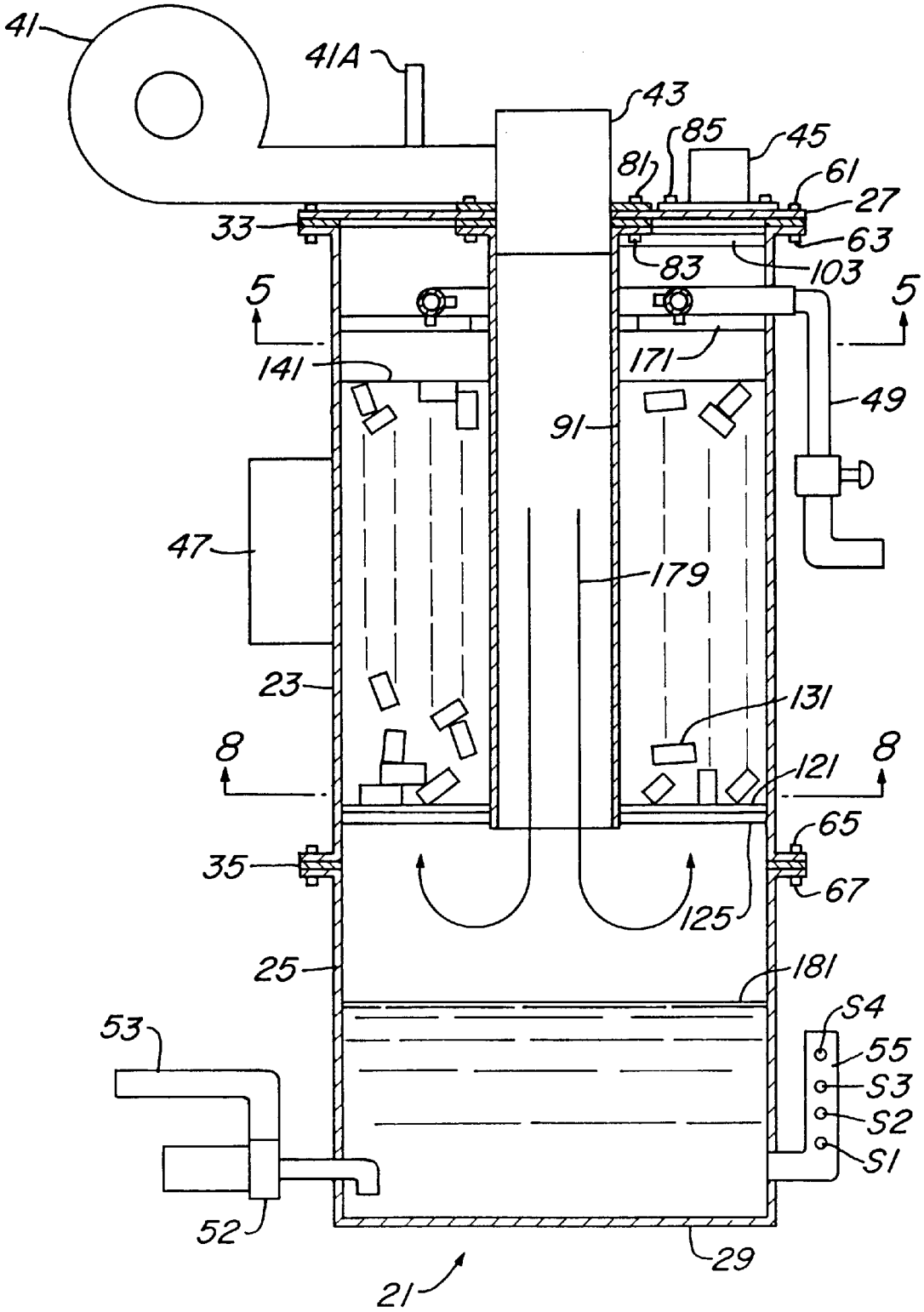
FIG. 2 is a cross-sectional view of the water heater of FIG. 1.
Figure 3:
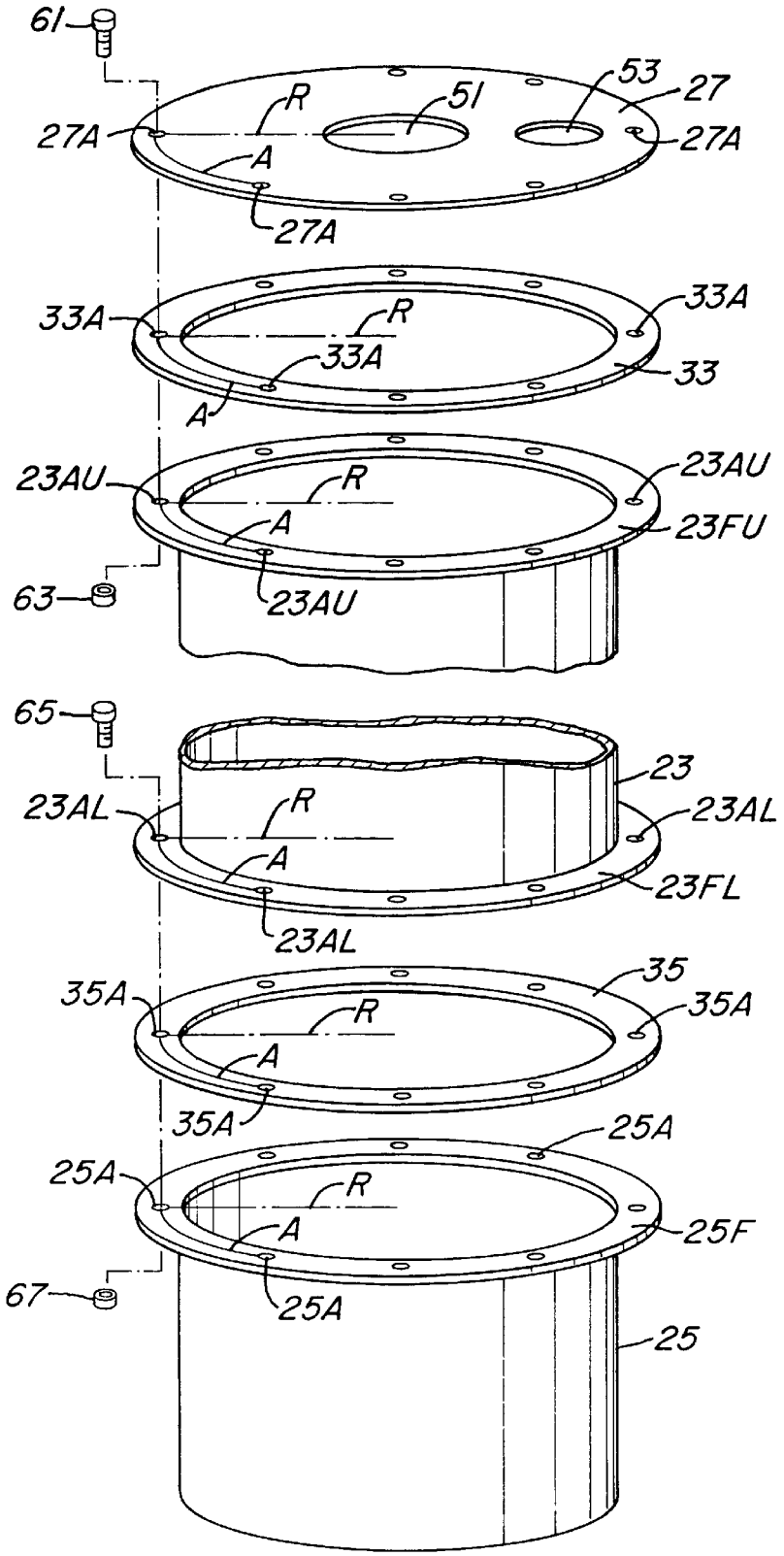
FIG. 3 is an exploded view of the outer wall structure of the water heater of FIGS. 1 and 2.
Figure 4:
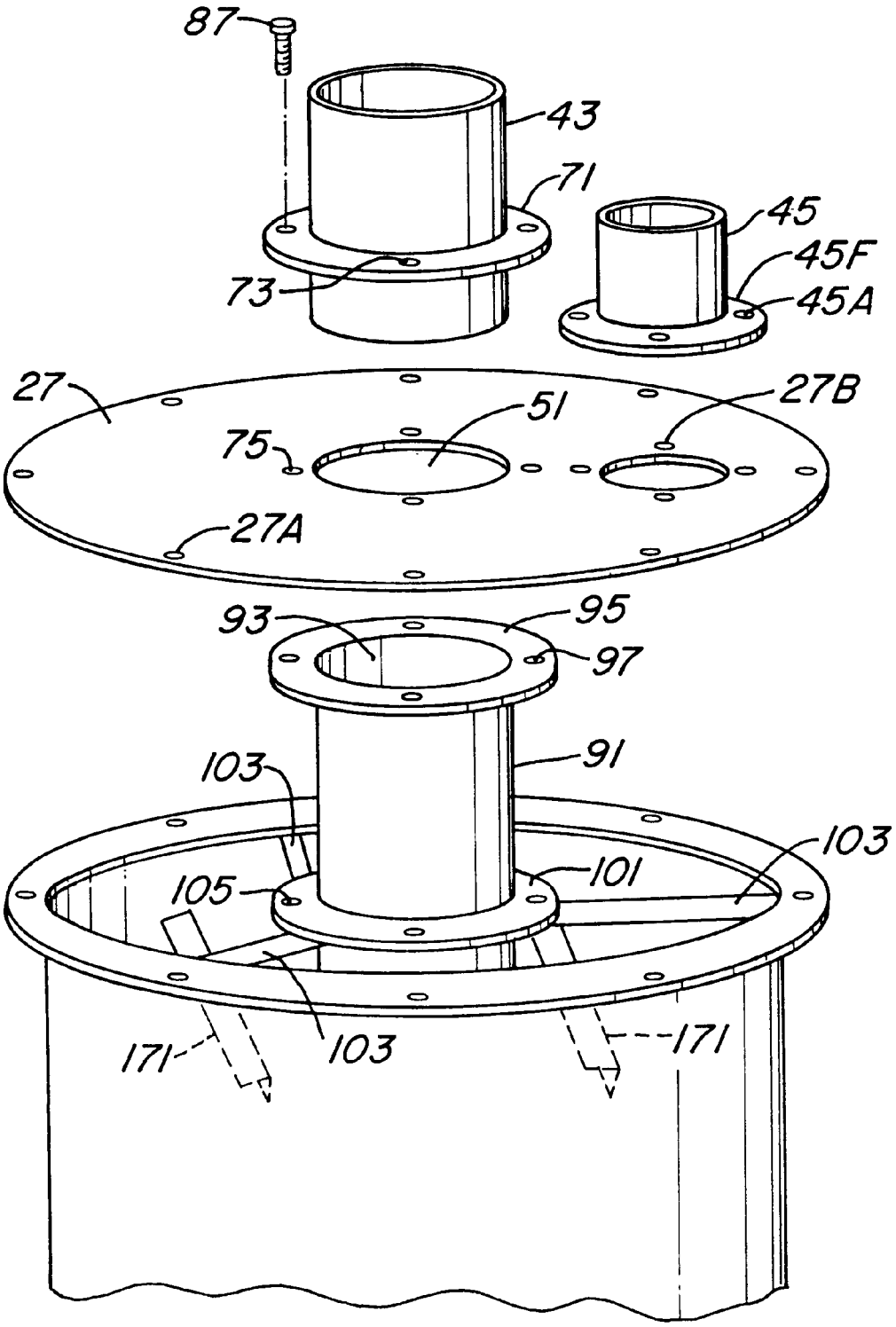
FIG. 4 is a partial exploded view of the top of the water heater of the invention.
Figure 5:
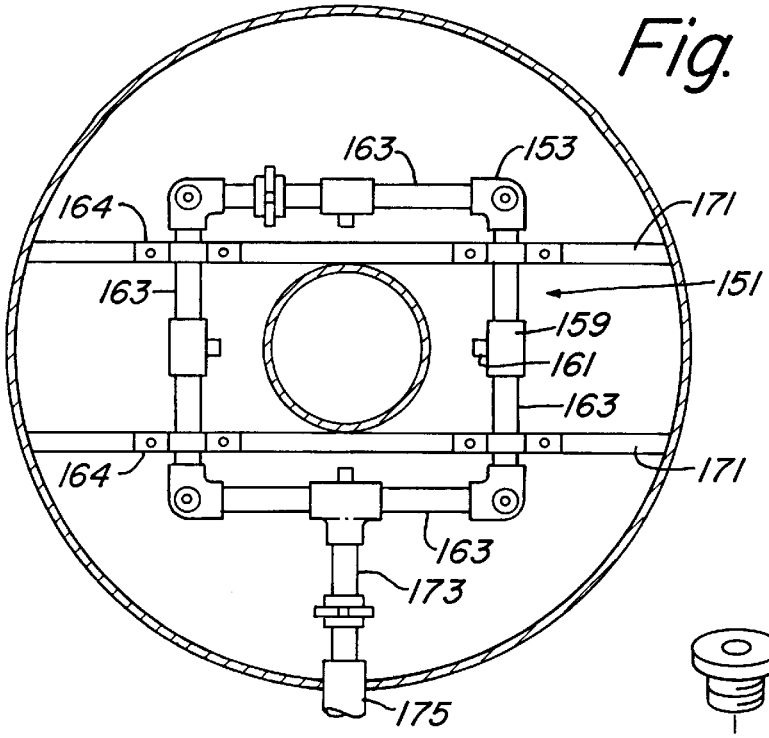
FIG. 5 is a cross-sectional view of FIG. 2 as seen along lines 5—5 thereof.
Figure 6:
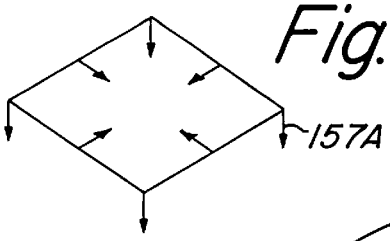
FIG. 6 illustrates the flow paths of water from the nozzles of FIG. 5.
Figure 7:
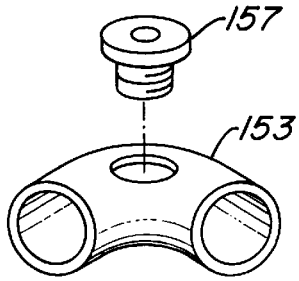
FIG. 7 illustrates one of the corner nozzles of FIG. 5.

The expanded metal wall 121 supports a plurality of PALL ring members 131 which extend upward to a level 141 below the upper wall 27 as shown in FIG. 2. The members 131 are well known metal members formed in an open cylindrical shape with a series of turn in cuts as disclosed in U.S. Pat. No. 4,275,708.

A spray nozzle device 151 comprising elbows 153 with water nozzles 157 and pipe sections 159 with water nozzles 161 connected together with pipe members 163 is supported around the flame tube 91 below the wall 27 and above the upper level 141 of the members 131. Support is by way of angle iron members 171 connected to the inside of wall 23. Four U bolts 164 connect two of the pipe members 163 to the supports 121. A pipe member 173 also is coupled to the cold water inlet pipe 49 which extends through an opening 175 formed through the wall 23. The nozzles 157 are directed to spray water downward as shown by arrows 157A directly on the members 131 and the nozzles 161 are directed to spray water laterally onto the upper end of the flame tube 91. This latter feature allows improved cooling of the flame tube 91 to prevent damage to the tube 91 from the heat of the flame which may reach 2800 degrees F. In addition, since the member 151 and nozzles 157 and 161 are separate from the upper wall 27, repair and cleaning is simplified.

In operation, air and fuel (natural gas or propane gas) are fed from the blower 41 and from a fuel pipe 41A to the burner 43 where they are mixed and ignited. Flame 179 is forced downward into the flame tube 91. Heat from the flame travels downward and then upward through the openings 121A of the expanded metal member 121 and upward through the members 131. Water is sprayed onto the members 131 and to the upper portion of the flame tube 91 which then flows downward through the ring members 131. Heat from the flame and members 131 is imparted to the cold water and hot water 181 is collected in the lower part of the sump of the cylinder 25 and then pumped out by the pump 51 by way of the outlet 53. Exhaust gases flow upward and outward through the exhaust 45.

The components of this apparatus including members 23, 25, 27, 29, 91, 121, and the water nozzle device 121 (except the nozzles 157) may be made of a stainless steel. The nozzles 157 may be formed of brass. In one embodiment, the inside diameters of walls 23 and 25 may be 28"; the height of the apparatus 21 may be 72"; the height of the wall 25 may be 29"; the inside diameter of the tube 91 may be 8"; and the length of the tube 91 may be 41½". The member 121 may be located a distance of 30" from the bottom wall 29. The nozzles 161 may be located about 6" from the outside wall of the tube 91 and the nozzle device 151 may be located about 8" from the inside surface of the upper wall 27. The members 131 may be stacked upward from the wall 121 about 29" such that the distance between the upper level 141 of the members 131 and the inside surface of the wall 27 may be 13". It is to be understood that the apparatus 21 may have dimensions other than those listed above.

The over flow pipe 55 has four switches S1, S2, S3, and S4. The switches report to a programmable logical controller in the control unit 47 which controls incoming water and the pump 51 to allow hot water to be pumped out of the apparatus to a holding tank. As the water level reaches the level of the second switch S2, the unit 47 starts the pump and an arrangement is provided such that the pump pumps less water out than the amount of incoming water. When the water level reaches the level of the third switch S3, the pump pumps more water out than the amount of incoming water. As the water level reaches the level of switch S1, the system shuts down and the unit 47 recycles the process. If the water level reaches the level of the fourth switch S4, the incoming water is shut off and the pump pumps out water until the water level reaches the level of the first switch S1. The system then shuts down and the unit 47 recycles the process.

Figure 9:
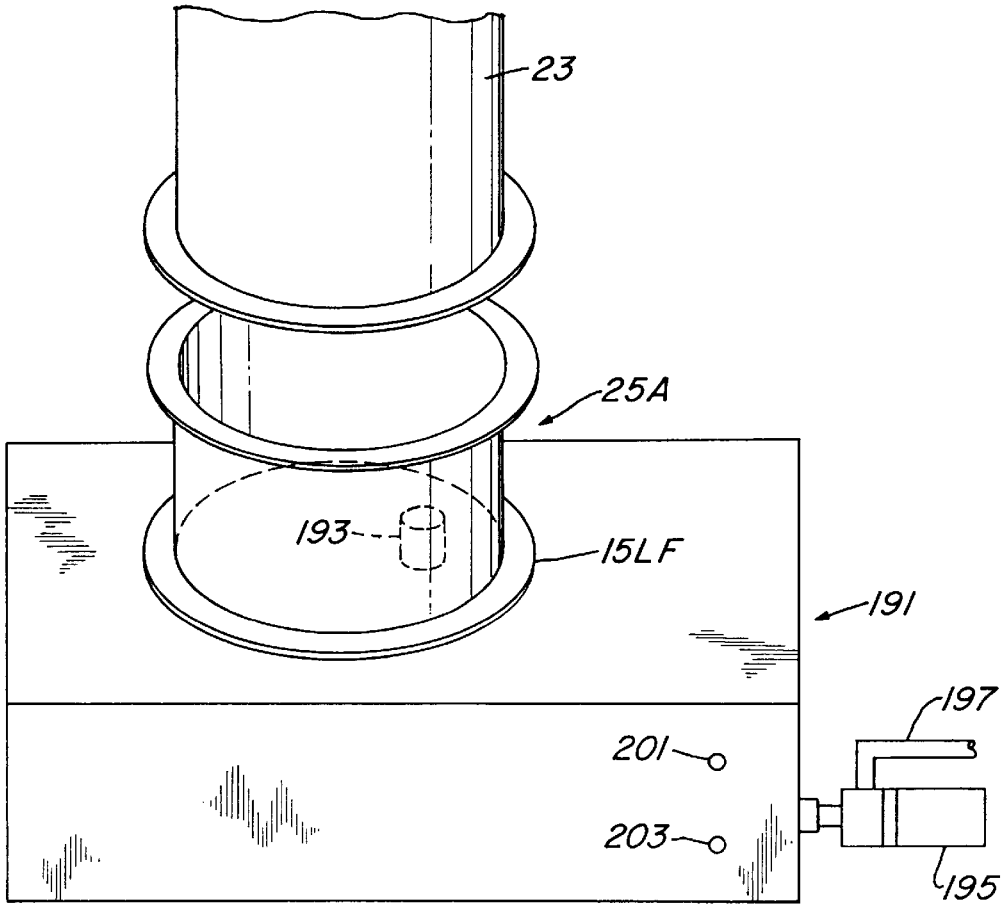
FIG. 9 is another embodiment of the invention employing a large storage tank.

Referring to FIG. 9, the lower section 25 may be replaced with section 25A having a lower end with a flange 15LF connected by bolts (not shown) to the top of the large storage tank 191. Section 25A incorporates an internal vertical drain pipe 193 leading to the storage tank. This dispenses with the need of a transfer pump. The modular design of the system lends itself to facilitate this change. In FIG. 9, there is disclosed a pump 195 with an outlet 197 for pumping hot water from the storage tank 191. Members 201 and 203 are stop and start switches. When the water level reaches switch 201, the system shuts down. When water is pumped out of the tank and the water level reaches switch 203, the system starts again to pump more water into the inlet pipe 49 to provide more hot water in the tank 191.

We claim:

1. A water heating apparatus, comprising:

a container comprising spaced upper and lower walls and a side wall extending between said upper and lower walls defining an interior of said container, an inlet opening formed through said upper wall, an elongated hollow flame tube located within the interior of said container and having an upper end coupled to said inlet opening of said upper wall and extending downward, combustion means coupled to said upper wall for directing a flame into said upper end of said flame tubes, a plurality of water nozzles coupled together by conduit means located in the upper portion of the interior of said container and surrounding the upper portion of said flame tube with selected ones of said plurality of nozzles being positioned to direct water against said flame tube and the other of said plurality of nozzles being positioned to direct water downward into the zone between said combustion chamber and said side wall for forming hot water for flow into the lower portion of the interior of said container, a water inlet conduit extending into the interior of said container and coupled to said conduit means for supplying water from a water source, separate from said water heating apparatus, to said plurality of water nozzles by way of said conduit means, and a water outlet coupled to the lower portion of the interior of said container for removing heated water from the interior of said container.

2. The water heating apparatus of claim 1, wherein:

said side wall of said container comprises a central axis, said inlet opening is located in the central portion of said upper wall, an exhaust opening formed through said upper wall between said inlet opening and the outer edge of said upper wall, an exhaust means coupled to said exhaust opening, said upper wall being removably coupled to the upper end of said side wall such that said upper wall with said combustion means and said exhaust means may be located at different angular positions about said central axis relative to the upper end of said side wall, means for removably coupling said upper wall with said combustion means and said exhaust means, to said upper end of said side wall at different angular positions about said central axis.

3. The water heating apparatus of claim 2, wherein:

said side wall comprises a cylindrical side wall having an upper portion and a lower portion, said upper and lower portions have lower and upper ends respectively, said upper wall being coupled to the upper end of said upper portion, said lower wall being coupled to the lower end of said lower portion, said upper and lower portions having lower and upper ends respectively removably coupled together such that said upper and lower portions may be coupled together at different angular positions about said central axis and relative to each other, means for removably coupling said lower and upper ends of said upper and lower portions together at different angular positions about said central axis and relative to each other.

4. The water heating apparatus of claim 1, wherein:

said side wall comprises a cylindrical side wall having a central axis with said cylindrical side wall comprising an upper portion and a lower portion, said upper and lower portions have lower and upper ends respectively, said upper wall being coupled to the upper end of said upper portion, said lower wall being coupled to the lower end of said lower portion, said upper and lower portions having lower and upper ends respectively removably coupled together such that said upper and lower portions may be coupled together at different angular positions about said central axis and relative to each other, means for removably coupling said lower and upper ends of said upper and lower portions together at different angular positions about said central axis and relative to each other.

5. A water heating apparatus, comprising:

a container comprising spaced upper and lower walls and a side wall extending between said upper and lower walls defining an interior of said container, an inlet opening formed through said upper wall, an elongated hollow flame tube located within the interior of said container and having an upper end coupled to said inlet opening of said upper wall and extending downward, combustion means coupled to said upper wall for directing a flame into said upper end of said flame tube, a plurality of water nozzles coupled together by conduits located in the upper portion of the interior of said container and surrounding the upper portion of said flame tube for directing water against said flame tube and downward into the zone between said combustion chamber and said side wall for forming hot water for flow into the lower portion of the interior of said container, said side wall of said container comprises a central axis, said inlet opening is located in the central portion of said upper wall, an exhaust opening formed through said upper wall between said inlet opening and the outer edge of said upper wall, an exhaust means coupled to said exhaust opening, said upper wall being removably coupled to the upper end of said side wall such that said upper wall with said combustion means and said exhaust means may be located at different angular positions about said central axis relative to the upper end of said side wall, means for removably coupling said upper wall to the upper end of said side wall at different angular positions about said central axis.

6. The water heating apparatus of claim 5, wherein:

said side wall comprises a cylindrical side wall comprising an upper portion and a lower portion, said upper wall being coupled to the upper end of said upper portion, said lower wall being coupled to the lower end of said lower portion, said upper and lower portions having lower and upper ends respectively removably coupled together such that said upper and lower portions may be coupled together at different angular positions about said central axis and relative to each other, means for removably coupling said lower and upper ends of said upper and lower portions together at different angular positions about said central axis and relative to each other.

7. A water heating apparatus, comprising:

a container comprising spaced upper and lower walls and a side wall extending between said upper and lower walls defining an interior of said container, an inlet opening formed through said upper wall, an elongated hollow flame tube located within the interior of said container and having an upper end coupled to said inlet opening of said upper wall and extending downward, combustion means coupled to said upper wall for directing a flame into said upper end of said flame tube, a plurality of water nozzles coupled together by conduits located in the upper portion of the interior of said container and surrounding the upper portion of said flame tube for directing water against said flame tube and downward into the zone between said combustion chamber and said side wall for forming hot water for flow into the lower portion of the interior of said container, said side wall comprises a cylindrical side wall having a central axis with said cylindrical side wall comprising an upper portion and a lower portion, said upper and lower portions have lower and upper ends respectively, said upper wall being coupled to the upper end of said upper portion, said lower wall being coupled to the lower end of said lower portion, said upper and lower portions having lower and upper ends respectively removably coupled together such that said upper and lower portions may be coupled together at different angular positions about said central axis and relative to each other, means for removably coupling said lower and upper ends of said upper and lower portions together at different angular positions about said central axis and relative to each other.

* * * * *